United States Patent [19]

Matsumoto

[11] Patent Number: 4,662,262

[45] Date of Patent: May 5, 1987

[54] ELECTRONIC MUSICAL INSTRUMENT HAVING AUTOPLAY FUNCTION

[75] Inventor: Naoaki Matsumoto, Tokyo, Japan

[73] Assignee: Casio Computer Co., Ltd., Tokyo, Japan

[21] Appl. No.: 836,674

[22] Filed: Mar. 5, 1986

[30] Foreign Application Priority Data

Mar. 8, 1985 [JP] Japan ..... 60-44662

[51] Int. Cl.[4] ..... G10H 1/42; G10H 7/00

[52] U.S. Cl. ..... 84/1.03; 84/DIG. 12

[58] Field of Search ..... 84/1.03, DIG. 12

[56] References Cited

U.S. PATENT DOCUMENTS 4,309,932 1/1982 Baker ..... 84/1.03
4,339,980 7/1982 Hooke et al. ..... 84/DIG. 12
4,378,720 4/1983 Nakada ..... 84/1.03
4,387,620 6/1983 Okamoto et al. ..... 84/1.03

*Primary Examiner*—S. J. Witkowski
*Attorney, Agent, or Firm*—Frishauf, Holtz, Goodman & Woodward

[57] ABSTRACT

An electronic musical instrument having an autoplay function comprises a memory device where musical data is stored, a musical tone signal generating circuit for generating musical tone signals in response to musical data read out from the memory device, and a controller for reading out musical data from the memory device and feeding the readout data to the musical tone signal generating means in a timed relation to the progress of music. To repeat the autoplay of a musical piece, the controller is arranged to read out musical data from the start address in synchronism with the tempo of a musical piece or at the timing of the first beat in a bar after the readout of the last musical tone data.

8 Claims, 10 Drawing Figures

FIG. 2

| |
|---|
| BEAT SETTING DATA |
| TONE COLOR BANK NO. |
| EFFECT DATA |
| NOTE I (TONE PITCH) |
| NOTE I DURATION |
| NOTE II (TONE PITCH) |
| NOTE II DURATION |
| REST I |
| REST I DURATION |
| NOTE III |
| ⋮ |
| NOTE (END) |
| NOTE DURATION |
| END MARK |

FIG. 3

| BEAT | MAX (HEXADECIMAL) | |
|---|---|---|
| | 1 BAR | 2 BARS |
| 2 | 2F | 5F |
| 3 | 47 | 8F |
| 4 | 5F | BF |

ELECTRONIC MUSICAL INSTRUMENT HAVING AUTOPLAY FUNCTION

BACKGROUND OF THE INVENTION

This invention relates to an apparatus for automatically and repetitively playing a musical piece.

Recently, various electronic musical instruments having an autoplay function have been realized. Such electronic musical instruments include a semiconductor memory (ROM) in which the note and rest data constituting a musical piece are stored sequentially. These musical data are read out from the ROM at a rate corresponding to the tempo of the musical piece, to thereby sound musical tones.

In addition to the automatic reproduction of musical pieces, electronic musical instruments having an autoplay function are used for the purpose of keyboard practice by beginners, repetitive autoplay of a musical piece being particularly desirable as a practice aid for beginners.

In repetitive autoplay of a musical piece, it is desired that the timing between the sounding of the last note of the piece in one play and the sounding of the first rote of the piece in a subsequent play be such that a smooth transition, without undue interruption and in tempo with the music, occurs.

SUMMARY OF THE INVENTION

An object of the invention is to provide an improved apparatus having an autoplay function.

Another object of the invention is to provide an electronic musical instrument with a repeat autoplay function suited for the practice of an instrument timed to the musical piece to be autoplayed.

A further object of the invention is to provide an electronic musical instrument with a repeating autoplay function, in which the first tone of a musical piece is sounded in a succeeding play in a timed relation to the tempo of the musical piece which has been previously played.

According to the invention, an automatic musical instrument having an autoplay function comprises memory means for storing musical data of a musical piece to be played; musical tone signal generating means for generating musical tone signals in response to applied musical data; readout means for reading out the musical data from the memory means in response to an applied clock signal and in synchronism with the tempo of the musical piece, and for feeding the readout data to the musical tone signal generating means for an autoplay of the musical piece; and repeat play means, coupled to the readout means, for restarting the autoplay of the musical piece in synchronism with the tempo of the musical piece so far played and in response to the read out of musical data representing the last musical tone of the piece.

BRIEF DESCRIPTION OF THE DRAWINGS

FIG. 2 shows the format of musical data stored in a memory section;

FIG. 3 is a diagram explaining the maximum counts, corresponding to the times of musical pieces, of the bar counter shown in FIG. 1;

FIG. 5 is a flow chart illustrating an operation that takes place when a start switch is turned on;

FIG. 6 is a flow chart illustrating an operation that takes place when a stop switch is turned on;

FIG. 7 is a flow chart illustrating an operation that takes place when a reset switch is turned on;

FIG. 8 is a flow chart illustrating an operation that takes place when a repeat switch is turned on;

DETAILED DESCRIPTION OF THE PREFERRED EMBODIMENT

An embodiment of the invention will now be described in connection with a microcomputer-operated electronic musical instrument.

Figure 1:
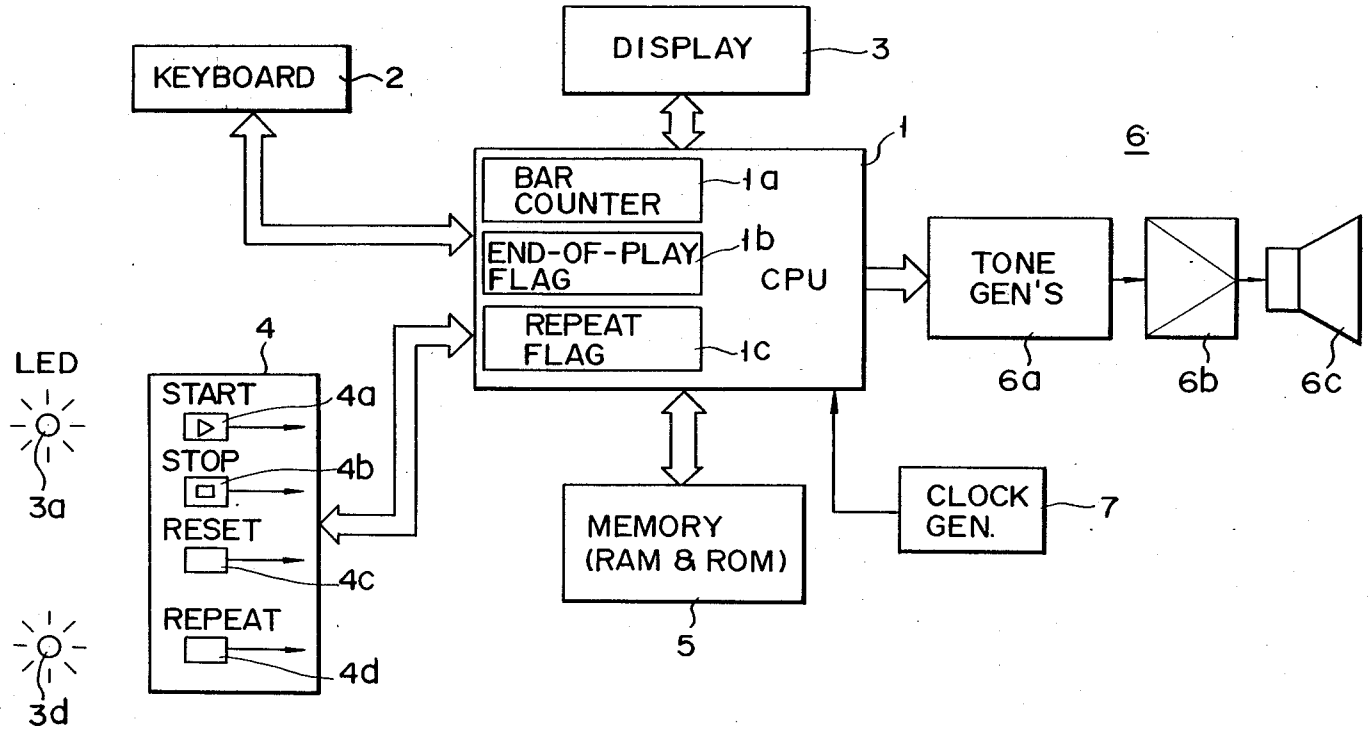
FIG. 1 is a block diagram of an electronic musical instrument according to an embodiment of the invention.

Referring now to FIG. 1, the electronic musical instrument embodying the invention includes a central processor unit, CPU 1. Keyboard section 2, display section 3, repeat play switch section 4 and memory section 5 are coupled to CPU 1. Tone generation section 6 and clock signal generation section 7 are, likewise, coupled to CPU 1. Tone generation section 6 includes tone generating circuit 6*a* which generates a tone signal according to tone data supplied from CPU 1, amplifier 6*b* and loudspeaker 6*c*. Tone generating circuit 6*a* is arranged to simultaneously generate a plurality of tone signals. To this end, tone generating circuit 6*a* has a plurality of tone generation channels or, alternatively, a time-division processing function, as is well known in the art.

Keyboard 2 is used for regular manual play as well as for practice play timed with the autoplay of a musical piece. Key operation signals from the keyboard are fed to CPU 1. During manual play, CPU 1 couples tone data corresponding to keys operated on keyboard 2 to tone generation section 6. Display section 3 includes a liquid crystal display unit, for displaying messages to the player, and also light-emitting diodes (LEDs) for displaying a switch operation state of switch section 4.

Repeat play switch section 4 includes start key 4*a*, stop key 4*b*, reset key 4*c* and repeat key 4*d*. Start key 4*a* is used to designate the start of autoplay of a musical piece. Stop key 4*b* is used to stop autoplay, reset key 4*c* is for initialization of autoplay, and repeat key 4*d* is operated to repeat autoplay. Operation signals of these keys are fed to CPU 1. Display unit 3 includes LEDs 3*a* and 3*d* which are disposed above start key 4*a* and repeat key 4*d*, respectively, to indicate either a repeat mode or a single play mode of the autoplay in accordance with the switch operation state of the repeat play switch section.

Memory section 5 includes a ROM and a RAM, in which operation programs of CPU 1 are stored, and a RAM for storing musical tone data for the autoplay. In the autoplay data RAM, tone pitch data, duration data corresponding to the tone pitch data, rest data, rest duration data, etc., are stored in accordance with the progression of a musical piece. The musical tone data include, as shown in FIG. 2, time setting data, tone color bank number data, effect setting data and an end mark representing the end of the autoplay data in addition to the tone pitch data, duration data, rest data and rest duration data. Data representing a rest or rests subsequent to the last note to be sounded in the last measure of the musical piece is not included in the musical tone data stored in the RAM.

Clock signal generator 7 is of a variable frequency type, and supplies a basic clock signal specifying the speed or tempo of an autoplay to CPU 1. CPU 1 is responsive to the basic clock signal to read out the musical data from memory section 5 according to the progress of the musical piece. The basic clock signal has one cycle corresponding to 1/24 of the duration of a quarter note. The tempo of the autoplayed musical piece can be varied by varying the clock signal frequency.

CPU 1 internally includes programmable bar counter 1*a*, end-of-play flag register 1*b* and repeat flag register 1*c*. Bar counter 1*a* is initialized to count the basic clock signal in response to the operation of repeat key 4*d*. Counter 1*a* counts data corresponding to the number of beats in one bar or measure through counting of the basic clock signal. In counter 1*a*, the maximum count of beats in one bar and two bars is set for each piece of music on the basis of duple time, triple time and quadruple time. In this embodiment, counter 1*a* is adapted to count the beats in two bars repeatedly while the repeat key 4*d* is "on" in the autoplay mode. The maximum count of beats, which varies depending on whether the time of musical piece is duple, triple or quadruple time, is programmed according to the time setting data from memory section 5. The counting operation of counter 1*a* is synchronized with the operation of reading out musical data from memory section 5. End-of-play flag register 1*b* is set to "1" when an end mark is read out from memory section 5. Repeat flag register 1*c* is set to "1" when the repeat play mode is set with the operation of repeat key 4*d* in switch section 4.

Before describing the detailed operation of the electronic musical instrument having the above construction, the operations of keys 4*a* to 4*d* in repeat play switch section 4 will be briefly explained.

When reset key 4*c* is depressed, autoplay initialization is executed. In the initialization processing, bar counter 1*a* and flag registers 1*b* and 1*c* are reset, and an readout address of the musical data is set to the start address. When start key 4*a* is depressed, the readout of musical data is initiated from the start address of memory section 5 to start an autoplay of the given musical piece. At the same time, LED 3*a* is turned on to indicate the autoplay mode. When stop key 4*b* is depressed until the end of the autoplay, the autoplay is stopped and LED 3*a* is turned off. When start key 4*a* is depressed subsequently, the autoplay is restarted from where it had previously been stopped. Unless stop key 4*b* and reset key 4*c* are depressed until the end of the autoplay, the autoplay will continue, with LED 3*a* turning off as soon as the autoplay is completed.

The above operation takes place in the autoplay mode. When repeat key 4*d* is depressed, LED 3*d* is turned on, and a repeat mode is set. When repeat key 4*d* is operated, LED 3*d* is turned off, and the repeat mode is released. After the last musical tone of music has been sounded in the repeat mode, the music is repeated at a timing corresponding to the first beat of the bar which comes after the lapse of a time interval corresponding to one bar of the musical piece being played, from the end of and including the last musical tone of the previously played bar. So long as the operation of the musical instrument is in the repeat mode, the music is played repeatedly. It is a feature of this embodiment to synchronize the start timing of the repetitive play with the timing of the first beat in a bar coming after the last tone of the musical piece.

Now, the operation of the electronic musical instrument according to the invention will be described in detail with reference to the flow charts of FIGS. 4 to 9.

Figure 4:
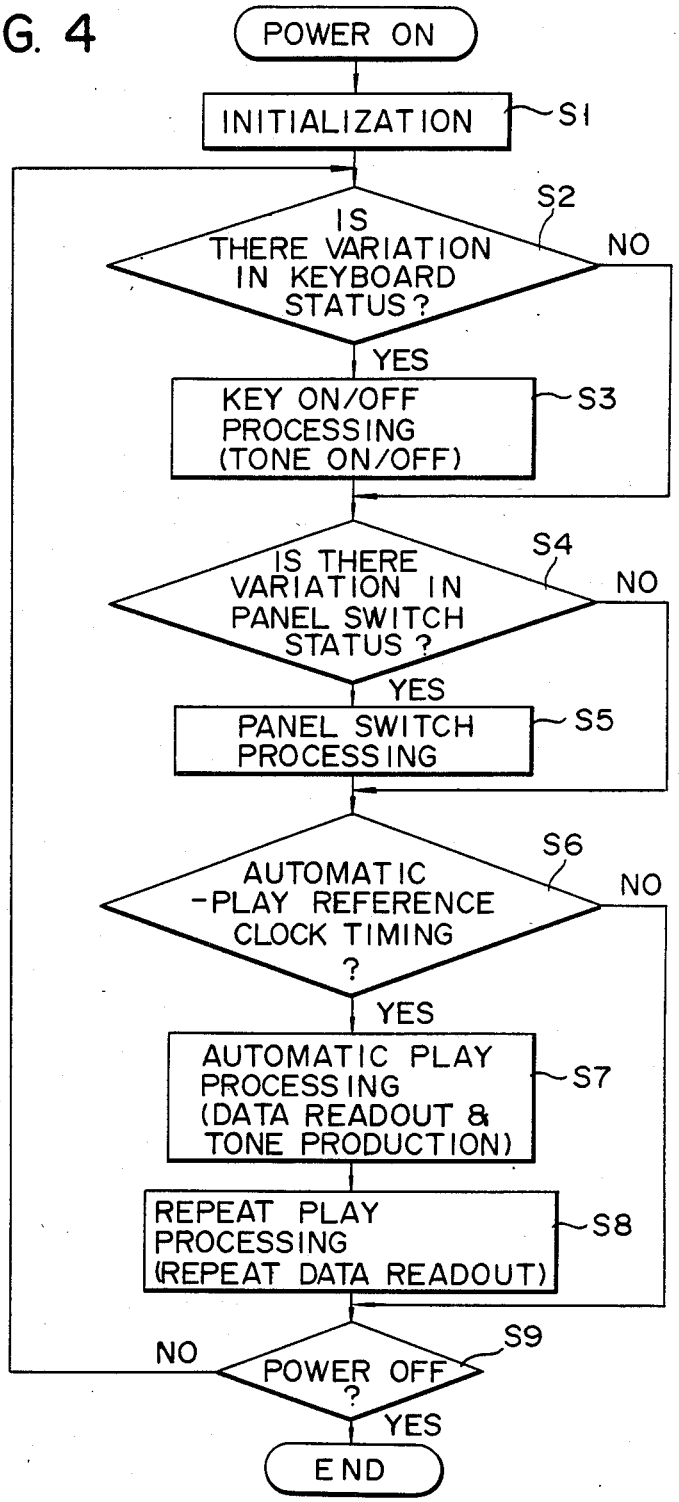
FIG. 4 is a flow chart explaining the operation, carried out from power-on till power-off, of the electronic musical instrument of the invention.

The flow chart of FIG. 4 illustrates the operation of the electronic musical instrument according to the invention, from power-on time till power-off time. When power is turned on, initialization is executed in step S1 similar to the case when the reset key is depressed as noted above. Then, a check as to whether there is any variation in the status of keyboard 2 (i.e., any key-on or key-off) is done in step S2, as in existing microcomputer-operated electronic musical instruments. When a variation in the keyboard status is detected, a key-on or key-off processing is executed in step S3. In the case of the key-on processing, CPU 1 supplies key data of a depressed key on the keyboard to tone generation section 6. A tone corresponding to the note of that key thus is sounded until the key is released. When a key release is detected, CPU 1 executes a key-off processing by causing tone generation section 6 to stop the sounding of the tone.

When step S3 is over, or when no variation of the keyboard status is detected in step S2, a check is done in step S4 as to whether there is any variation in the operation of panel switches, including key switches, in repeat play switch section 4. When a variation in the panel switch status is detected, a corresponding panel switch processing is executed in step S5. The processing concerning the individual key switches in the repeat play switch section in this step will be described later.

In subsequent step S6, a check is done as to whether there is a clock signal issued at the autoplay reference timing (which corresponds to a period of 1/24 of the duration of a quarter note, as noted above). When the autoplay clock signal is supplied to CPU 1, an autoplay processing is executed in step S7, as in the usual autoplay apparatus. During autoplay processing, musical data is read out in the format shown in FIG. 2 from memory section 5 in synchronism with the clock signal. The note data is then fed to tone generation section 6 so that musical tones corresponding to the note data read out are progressively sounded. The duration of each musical tone is measured by a duration counter (not shown), which counts reference clock signals for a period specified by the duration data subsequent to the note data.

In the case of the repeat play mode, a repeat play processing is executed in subsequent step S8. More specifically, after the last musical tone has been sounded in the previous autoplay, the timing at which the first tone is to be sounded in the next autoplay is synchronized with the first beat of the next bar but one to the last bar which includes the sounded last tone of the musical piece. In subsequent step S9, a check is done as to whether power is turned off. When power is not turned off, the operation is repeated from step S2. A keyboard play drill timed to autoplay, i.e., simultaneous sounding of tones based on autoplay and manual play, can be attained through plural-channel or time-division processing of tone signals in tone generation section 6, as is well known in the art. The tone on/off processing based on the keyboard operation in this case is executed in steps S2 and S3.

Figure 5:
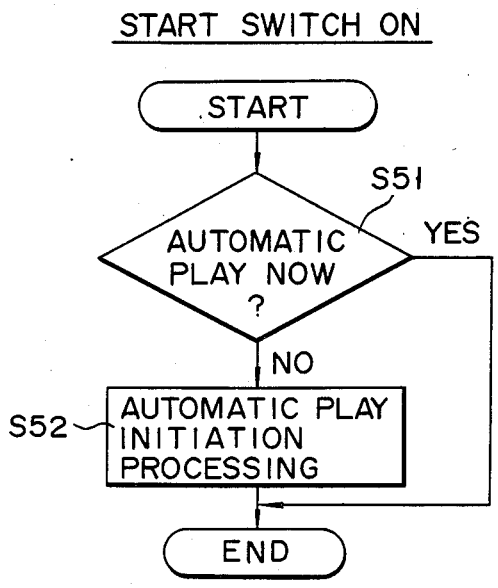

Processing involving the individual panel switches will now be described with reference to FIGS. 5 to 8. FIG. 5 illustrates an operation that takes place when start switch 4*a* is turned on. First a check is done in step S51 as to whether an autoplay is being carried out. This check is done by checking whether musical data is being read out from memory section 5. If no autoplay is in force, an autoplay initiation processing is executed in step 52. In this processing, the maximum count of bar counter 1*a* is set according to the time setting data of the music data shown in FIG. 3. At the same time, timbre data and effect data are fed to a timbre circuit and an effect circuit, respectively, in tone generation section 6. Further, a start address, from which the tone data is to be read out, is determined.

Figure 6:
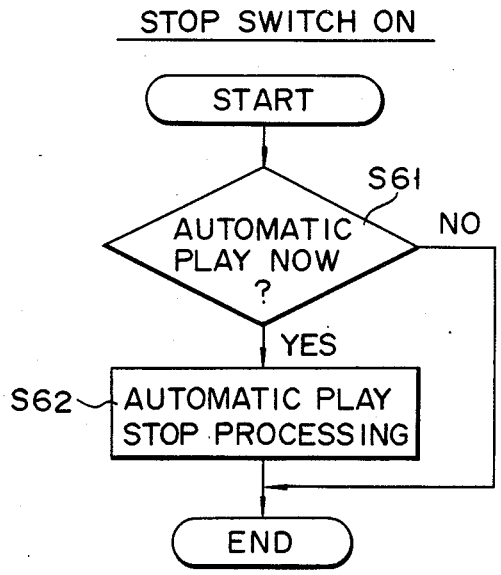

When stop switch 4*b* is turned on, the operation shown in FIG. 6 takes place. More specifically, a check is first done in step S61 as to whether the apparatus is in autoplay. If so, an autoplay stop processing is executed in step S62.

Figure 7:
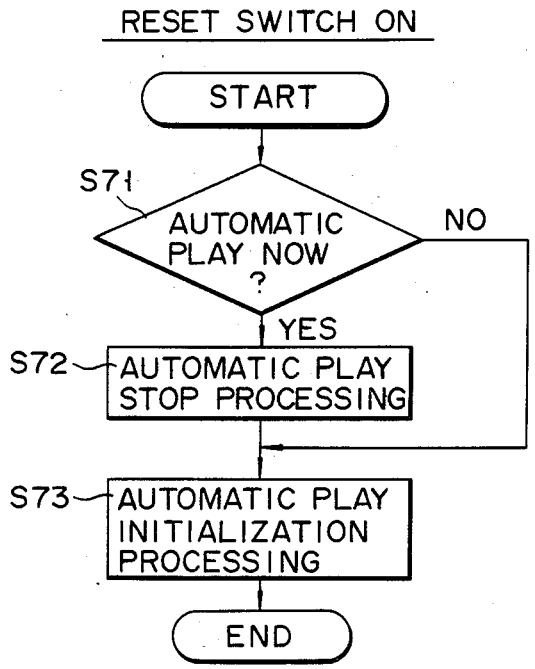

When reset switch 4*c* is turned on, the operation shown in FIG. 7 takes place. More specifically, a check is done in step S71 as to whether autoplay is being carried out. If so, an autoplay stop processing is executed in step S72. After the autoplay stop processing is executed, or when it is detected in step S71 that no autoplay is being carried out, an autoplay initiation processing is executed in step S73.

Figure 8:
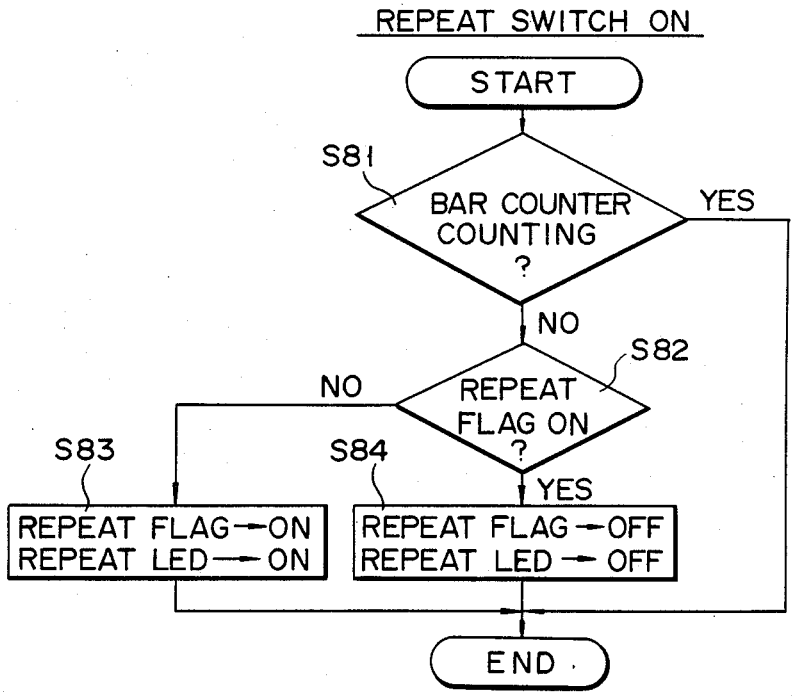

When repeat switch 4*d* is turned on, the operation shown in FIG. 8 takes place. First, a check is done in step S81 as to whether bar counter 1*a* is counting reference clock signals and the operation is in the rest condition. If not, a check is done in step S82 as to whether repeat flag register 1*c* is set. If flag register 1*c* is not set, setting of the flag register is performed and LED 3*d* is turned on in step S83. If it is detected in step S82 that flag register 1*c* is set, it is reset and LED 3*d* is turned off in step S84.

Now, the repeat play processing that is caused during autoplay will be described with reference to FIG. 9. To explain this operation, it is assumed that start key 4*a* and repeat key 4*d* have been operated in the panel switch processing (step S5) shown in FIG. 4, so that repeat flag register 1*c* is set, and the operation is in a repeat mode. In step S7 in FIG. 4, a single tone is sounded or turned off and then the repeat play is executed in step S8.

Figure 10:
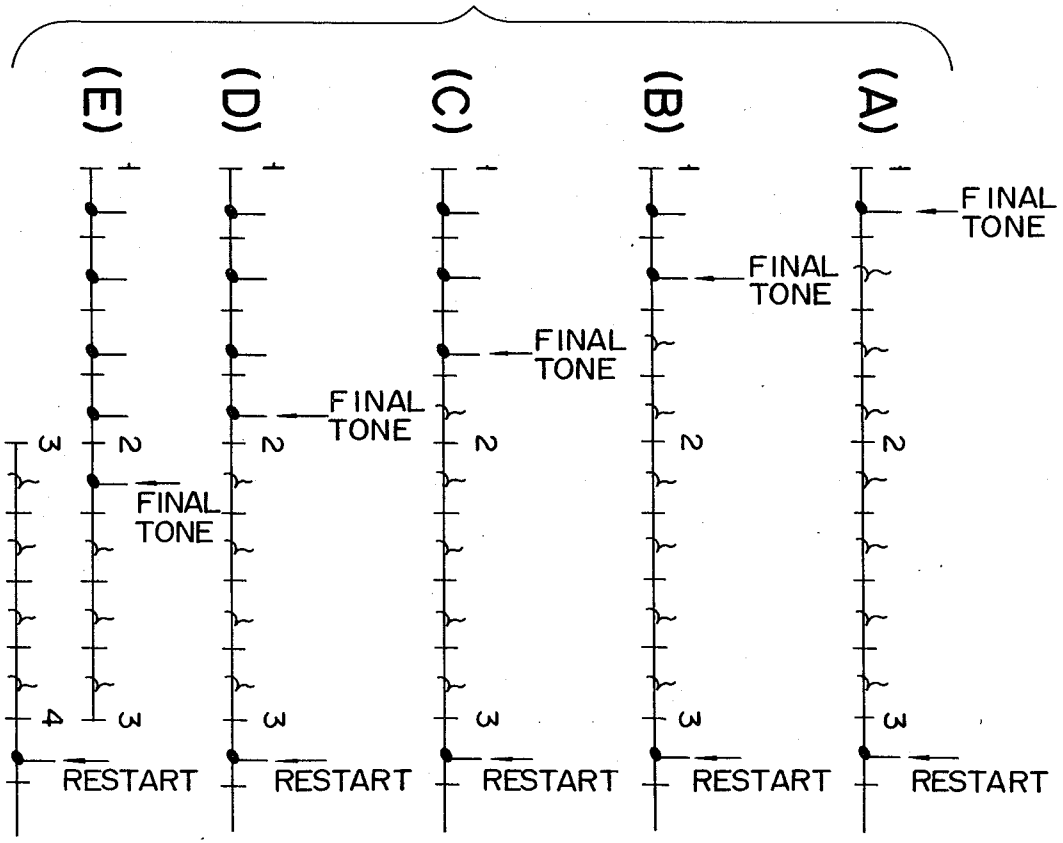
FIG. 10 is a timing chart explaining the operation according to the invention, in the repeat mode.

To facilitate understanding of the invention, the repeat play operation according to the invention will now be described with reference to the repeat play patterns shown in FIG. 10. It is to be noted that bar counter 1*a* counts the maximum number of beats in two bars (which is BF indicating 4 beats in the quadruple time, 8F indicating 3 beats in the triple time), and is reset when the count reaches the maximum number. FIGS. 10(A) through 10(D) show play patterns in the case where the count of the bar counter is less than the maximum number of beats in one bar when the last tone of musical piece is sounded. FIG. 10(E) shows the play pattern in the case where the count of the bar counter exceeds the maximum number of beats in one bar when the last tone of musical piece is sounded. According to the invention, in the case of the pattern shown in FIG. 10(A), autoplay is resumed with the first beat in the next bar at a time interval corresponding to seven-beat rest durations from the instant the last tone is sounded. In the case of the pattern shown in FIG. 10(B), autoplay is resumed with the first beat in the next bar after a time interval corresponding to 6-beat rest durations from the instant the last tone is sounded. As will be readily understood, autoplay is resumed with the first beat of the next bar after 5-beat rest durations from the instant the last tone shown in FIG. 10(C) is sounded, while it is resumed after a time interval of 4-beat rest durations in FIG. 10(A). In the case of the play pattern shown in FIG. 10(E), the count of bar counter 1*a* is data indicating five beats at the instant the last tone is sounded. This number is in excess of the maximum number of beats in a bar (which is data indicating four beats in this case). In this case, the count of the bar counter is altered, and autoplay is resumed after 7-beat rest durations from the instant the last tone has been sounded, as in the case of FIG. 10(A).

Figure 9:
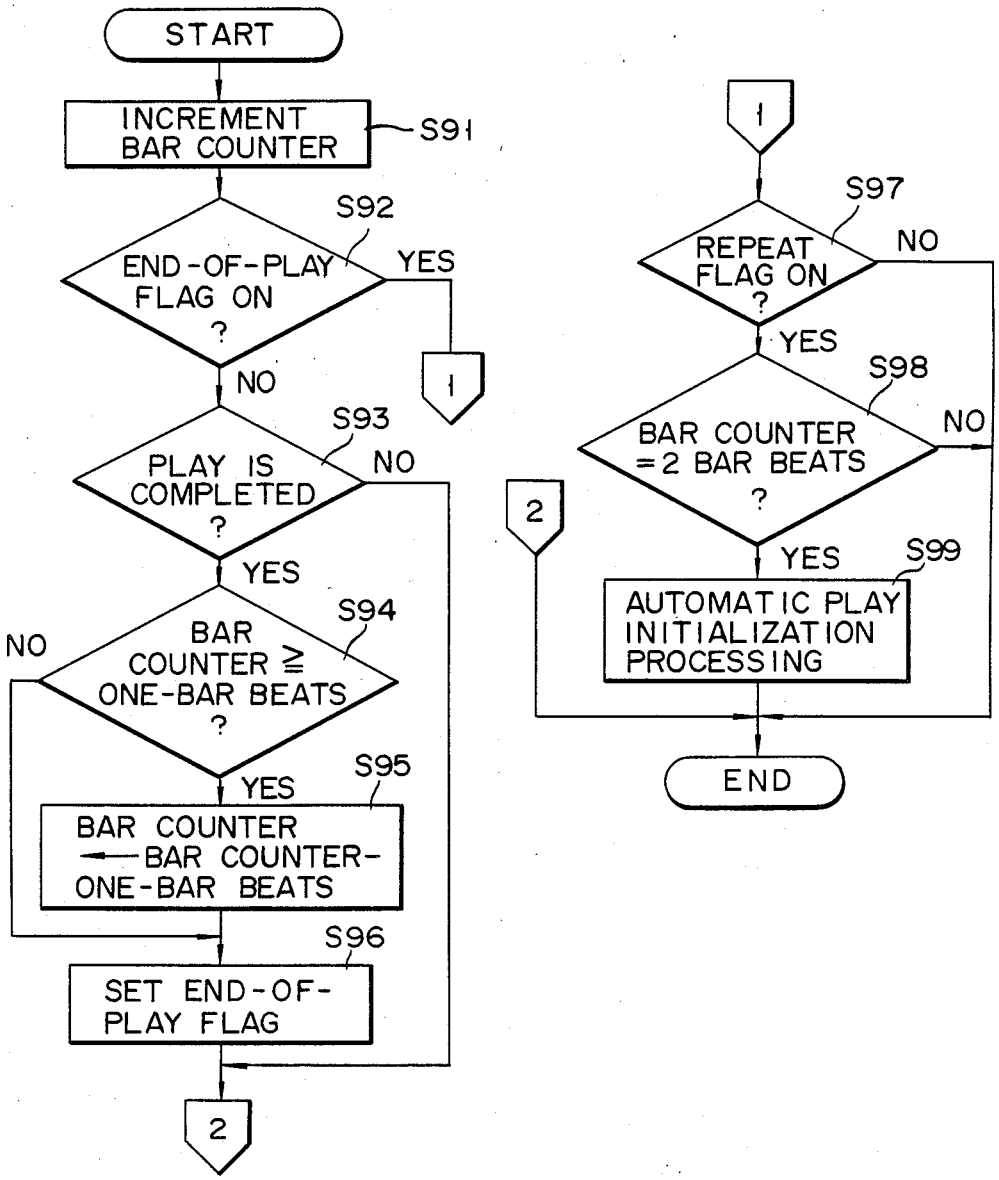
FIG. 9 is a flow chart illustrating an operation in a repeat mode.

The operation shown in FIG. 9 is executed for each cycle of the reference clock signal. In step S91, bar counter 1*a* is incremented by "1" for each cycle of the reference clock signal. A check is then done in step S92 as to whether end-of-play flag register 1*b* is set. Since the end-of-play flag register 1*b* is not set at this instant, the operation goes to step S93. In this step, a check is done as to whether the last tone has been sounded in the autoplay processing (in step S7 in FIG. 4). This is done by checking whether the end-of-play mark has been read out from memory section 5. If the last tone has not yet been sounded, the operation goes through END to the autoplay processing (step S7) in FIG. 4 to execute a play processing for one beat. Steps S91, S92 and S93 are repeated until the sounding of the last tone is completed.

If it is detected in step S93 that the sounding of the last tone is completed, the operation goes to step S94. In this step, the count of bar counter 1*a* is compared with the maximum count of beats in one bar (which is data indicating 4 beats in this case). The count of the bar counter data representing 1, 2, 3 and 4 beats in FIGS. 10(A) to 10(D), respectively. In FIG. 10(E), it is 5. If it is detected in step S94 that the count of bar counter 1*a* is less than the maximum number (4) of beats in one bar, as in the cases of FIGS. 10(A) to 10(D), the operation goes to step S96, in which the end-of-play flag is set "on". On the other hand, if the count of bar counter 1*a* is greater than the maximum number of bars in one bar, as in the case of FIG. 10(E), the routine goes to step S95, in which the maximum number of beats in one bar is subtracted from the count of bar counter 1*a*. As result, the count of bar counter 1*a* is changed from data indicating 5 beats to data indicating 1 beat in the example of FIG. 10(E).

After this processing, the end-of-play flag register is set "on". After the end-of-play flag register is set "on", counter 1*a* is incremented in step S91, and a check is done in step S92 as to whether the end-of-flag is "on". As the end-of-play flag has already been set "on", the operation goes to step S97, in which a check is done as to whether the repeat flag is "on". Since repeat key 4*d* has been turned on, as mentioned before, the routine goes to step S98. In this step, a check is done as to whether the maximum number of beats in two bars has been reached by bar counter 1*a*. If it is determined that the maximum number has been reached by the counter, an autoplay initialization processing is executed in step S99. That is, the repeat and end-of-play flag registers 1*c* and 1*b* are cleared, and the readout address of the memory section 9 is reset to the start address.

If detected in step S98 that the maximum number of beats in two bars has not yet been reached by bar counter 1*a*, steps S91, S92, S97 and S98 are repeated.

After the end-of-play flag 1*b* has been set in step S96, bar counter 1*a* is incremented by "1" in succession in step S91. This means that the rests are counted during a period of time from the completion of sounding of the last tone until the resumption of autoplay, as described in connection with FIG. 10. A similar operation is repeatedly performed after the resumption of autoplay.

It needs be understood that the autoplay is restarted after a time interval longer than one bar but shorter than two bars from the completion of sounding of the last tone in the previous play. For this reason, the start timing of repetitive autoplay will never be out of time with the previously played musical piece. Further, since a time interval longer than one bar is provided before the start of autoplay repetition, beginners are allowed sufficient time to ready themselves for the next practice session, done in coodination with and commencing from the resumption of autoplay.

The interval from the end of autoplay till the start of the next autoplay need not, however, be limited to a span longer than one bar and shorter than two bars; for instance it may be longer than two bars or shorter than one bar. Further, the music of autoplay may be a melody, a rhythm or an accompaniment.

What is claimed is:

1. An automatic playing apparatus, having an autoplay function, comprising:

memory means for storing musical data of a musical piece to be played;

musical tone signal generating means for generating musical tone signals in response to applied musical data;

readout means responsive to application of a clock signal for reading out the musical data from said memory means in synchronism with the tempo of the musical piece, and for feeding the readout data to said musical tone signal generating means for autoplay of the musical piece; and repeat play means coupled to said readout means, and responsive to the readout of musical data representing the last tone of the musical piece for restarting the autoplay of the musical piece in synchronism with the tempo of the musical piece so far played.

2. The automatic playing apparatus according to claim 1, wherein said repeat play means is arranged to restart the autoplay in synchronism with the timing of the first beat of a bar after the lapse of a time interval longer than one bar but shorter than two bars from the readout of musical data representing the last tone of the musical piece.

3. An electronic musical instrument, having autoplay function, comprising:

memory means for storing musical data of a musical piece to be played;

musical tone signal generating means for generating musical tone signals in response to applied musical data;

autoplay designating means operable to set said electronic musical instrument to an autoplay mode so that the musical data in said memory means is read out from a start address and supplied to said musical tone signal generating means for autoplay of the musical piece;

repeat play designating means, operable while said electronic musical instrument is in the autoplay mode, to set said electronic musical instrument to a repeat play mode for repetitive autoplay of the musical piece;

clock signal generating means for generating a clock signal synchronized with the tempo of the musical piece; and control means for performing an operation comprising the steps of:

reading out, in the autoplay mode, the musical data from said memory means in response to the clock signal and in synchronism with the tempo of the musical piece to feed the readout musical data to said musical signal generating means for autoplay of musical piece;

repeatedly counting the number of beats in at least one bar of the musical piece by counting the clock signal in response to said repeat play designating means;

detecting the readout of musical data representing the last tone of the musical piece being played, in response to the operation of said repeat designating means; and reading, in response to the detection of the read-out of the last musical tone data and counting of the clock signal, the musical data out of said memory means from the start address in synchronism with the tempo of the musical piece so far played to restart autoplay of the musical piece.

4. The electronic musical instrument according to claim 3, wherein said control means is arranged to restart the autoplay at the timing of the first beat in a bar after the lapse of a time interval longer than one bar and shorter than two bars from the readout of the last musical tone data.

5. An automatic playing apparatus, having an autoplay function, comprising:

memory means for storing musical data of a musical piece to be played;

musical tone signal generating means for generating musical tone signals in response to applied musical data;

readout means responsive to application of a clock signal for reading out the musical data from said memory means in synchronism with the tempo of the musical piece, and for feeding the readout data to said musical tone signal generating means for autoplay of the musical piece; and repeat play means, coupled to said readout means and responsive to the readout of the last musical data for detecting the timing of the first beat of a bar after the readout of the last musical tone data and for restarting autoplay of the musical piece at the timing of the first beat.

6. The automatic playing apparatus according to claim 5, wherein said repeat play means is arranged to restart autoplay in synchronism with the timing of the first beat of a bar after the lapse of a time interval longer than one bar but shorter than two bars from the readout of musical data representing the last tone of the musical piece.

7. An electronic musical instrument, having autoplay function, comprising:

memory means for storing musical data of a musical piece to be played;

musical tone signal generating means for generating musical tone signals in response to applied musical data;

autoplay designating means operable to set said electronic musical instrument to an autoplay mode so that the musical data in said memory means is read out from a start address and supplied to said musical tone signal generating means for autoplay of the musical piece;

repeat play designating means, operable while said electronic musical instrument is in the autoplay mode, to set said electronic musical instrument to a repeat play mode for repetitive autoplay of the musical piece;

clock signal generating means for generating a clock signal synchronized with the tempo of the musical piece; and control means for performing an operation comprising the steps of:

reading out, in the autoplay mode, the musical data from said memory means in response to the clock signal and in synchronism with the tempo of the musical piece to feed the readout musical data to said musical signal generating means for autoplay of the musical piece;

repeatedly counting the number of beats in at least one bar of the musical piece by counting the clock signal in response to said repeat play designating means;

detecting the readout of musical data representing the last tone of the musical piece being played, in response to the operation of said repeat designating means; and detecting, in response to the detection of the readout of the last tone data and counting of the clock signal, the timing of the first beat in a bar after the readout of the last musical data, and reading the musical data out of said memory means from the start address at the timing of the first beat in the bar to repeat autoplay of the musical piece.

8. The electronic musical instrument according to claim 7, wherein said control means is arranged to restart autoplay at the timing of the first beat in a bar after the lapse of a time interval longer than one bar and shorter than two bars from the readout of the last musical tone data.

* * * * *